US010458321B2

(12) United States Patent
Poltoratski et al.

(10) Patent No.: US 10,458,321 B2
(45) Date of Patent: Oct. 29, 2019

(54) CHARGER DEVICE WITH VARIABLE TURBINE GEOMETRY

(71) Applicant: Bosch Mahle Turbo Systems GmbH & Co. KG, Stuttgart (DE)

(72) Inventors: Roman Poltoratski, Stuttgart (DE); Florian Rentz, Stuttgart (DE); Ruediger Schwaeger, Stuttgart (DE); Senol Soeguet, Renningen (DE); Dirk Naunheim, Stuttgart (DE); Heinz B. Haiser, Ludwigsburg (DE); Jochen Laubender, Ingolstadt (DE)

(73) Assignee: BMTS Technology GmbH & Co. KG (DE)

( * ) Notice: Subject to any disclaimer, the term of this patent is extended or adjusted under 35 U.S.C. 154(b) by 683 days.

(21) Appl. No.: 15/077,631

(22) Filed: Mar. 22, 2016

(65) Prior Publication Data

US 2016/0281594 A1 Sep. 29, 2016

(30) Foreign Application Priority Data

Mar. 23, 2015 (DE) ..... 10 2015 205 208

(51) Int. Cl.
*F02B 37/24* (2006.01)
*F01D 17/16* (2006.01)
(Continued)

(52) U.S. Cl.
CPC ..... *F02B 37/24* (2013.01); *F01D 9/041* (2013.01); *F01D 17/16* (2013.01); *F01D 17/165* (2013.01);
(Continued)

(58) Field of Classification Search
CPC ..... F01D 9/041; F01D 17/16; F01D 17/165; F01D 5/141; F02B 37/24; F05D 2220/40; F05D 2240/121; F05D 2240/123
See application file for complete search history.

(56) References Cited

U.S. PATENT DOCUMENTS 6,502,398 B2 * 1/2003 Kapich ..... F01D 1/14 123/565
7,771,162 B2 * 8/2010 Castan ..... F01D 5/141 415/164
(Continued)

FOREIGN PATENT DOCUMENTS

CN 104428494 A 3/2015
DE 102004044324 A1 3/2006
(Continued)

OTHER PUBLICATIONS

Machine translation of EP 1,635,038 B1; retrieved from Espacent on Aug. 21, 2018.*
(Continued)

*Primary Examiner* — Jason D Shanske
*Assistant Examiner* — Sang K Kim
(74) *Attorney, Agent, or Firm* — Fishman Stewart PLLC

(57) ABSTRACT

A charger device may include a variable turbine geometry having guide vanes mounted rotatably in a van bearing ring. Each guide vane may have a top side that runs in convex fashion from a profile nose to a profile end. A concave recess may be arranged on a bottom side of each guide vane at the profile nose.

15 Claims, 1 Drawing Sheet

(51) Int. Cl.
*F01D 9/04* (2006.01)
*F01D 5/14* (2006.01)

(52) U.S. Cl.
CPC ..... *F01D 5/141* (2013.01); *F05D 2220/40* (2013.01); *F05D 2240/121* (2013.01); *F05D 2240/123* (2013.01)

(56) References Cited

U.S. PATENT DOCUMENTS 8,172,508 B2 * 5/2012 Mohamed ..... F01D 5/141 415/115
8,511,981 B2 * 8/2013 Small ..... F04D 29/444 415/148
8,641,382 B2 * 2/2014 Weber ..... F01D 17/165 416/223 A
10,006,297 B2 * 6/2018 Yoshida ..... F01D 5/043
2003/0079474 A1 * 5/2003 Finger ..... F01D 17/165 60/602
2010/0098529 A1 * 4/2010 Roby ..... F01D 17/165 415/160
2010/0296924 A1 * 11/2010 Boning ..... F01D 5/141 415/208.1
2015/0167685 A1 * 6/2015 Krausche ..... F01D 17/165 415/146
2016/0312651 A1 * 10/2016 Boening ..... F01D 5/048

FOREIGN PATENT DOCUMENTS

DE 102008004014 A1 7/2009
DE 102009006209 A1 8/2010
DE 102009031229 A1 1/2011
EP 1635038 A1 * 3/2006 ..... F01D 5/141
EP 1797283 A1 6/2007
WO WO-2013189506 A1 12/2013

OTHER PUBLICATIONS

English abstract for DE-102004044324A1.
English abstract for DE-102009031229A1.
English abstract for DE-102009006209A1.
German Search Report for DE-102015205208.7, dated Jan. 27, 2016.
China Office Action dated Aug. 2, 2018 for copending Chinese Application No. 201610132933.5.
English Abstract for CN104428494 (A).

* cited by examiner

CHARGER DEVICE WITH VARIABLE TURBINE GEOMETRY

CROSS-REFERENCE TO RELATED APPLICATIONS

This application claims priority to German Patent Application No. 10 2015 205 208.7, filed Mar. 23, 2015, the contents of which are hereby incorporated by reference in its entirety.

TECHNICAL FIELD

The present invention relates to a charger device with a variable turbine geometry, in particular an exhaust-gas turbocharger for a motor vehicle. The invention also relates to a guide vane for a charger device of said type.

BACKGROUND

EP 1 797 283 B1 has disclosed a generic charger device with a variable turbine geometry having guide vanes which are mounted rotatably in a vane bearing ring, wherein said guide vanes have a surface which runs in convex fashion from a profile nose to a profile end.

DE 10 2009 006 209 A1 has disclosed a further charger device with a variable turbine geometry, in particular an exhaust-gas turbocharger for a motor vehicle. By means of a correspondingly undulating form of the guide vanes in the manner of a dovetail-shaped silhouette, it is possible for an admission of a gas into multiple in flow ducts that are delimited by in each case two adjacent guide vanes to be made more uniform and oriented such that an inflow direction in the inflow duct corresponds to a flow direction of the gas in a circumferential direction. In this way, it is sought to achieve, in particular, reduced wear of the adjustment apparatus and thereby a lengthened service life of the charger device.

In general, known exhaust-gas turbochargers, or charger devices in general, are equipped with an electrical or pneumatic setting element which effects an adjustment of a variable turbine geometry. Here, the setting element is driven by way of an engine controller and moves a regulating rod which, in turn, acts on and rotates an actuator lever. The rotation of the actuator lever is transmitted by the adjustment shaft to the adjustment device. In order that the kinematic arrangement between setting device, setting element and variable turbine geometry functions smoothly, all of the components involved must exhibit a minimum amount of play, and must furthermore be freely movable.

For the adjustment or regulation of the mass flow, the profile of a guide vane included in the variable turbine geometry plays a crucial role. The aerodynamic force that acts on the guide vane profile owing to the flow passing around it generates an opening or a closing characteristic in conjunction with a bearing (in the region of a guide vane shaft). Here, an opening characteristic is advantageous because, in the event of a failure of the setting device, the guide vanes open and the vehicle can drive to a workshop without problems, albeit with reduced power. By contrast, in the case of a closing characteristic, the mass flow is reduced to such an extent that the engine is throttled with such intensity that severe malfunctions can arise. Aside from the regulating characteristic, the further demand on the profile is that it exhibits the best possible efficiency. Efficiency is a highly important feature in particular in the closed vane position, because here, the response behaviour (dynamics) of the engine is influenced. A high level of efficiency in a closed vane position corresponds to good dynamics.

SUMMARY

The present invention is concerned with the problem of specifying, for a charger device of the generic type, an improved or at least alternative embodiment which, aside from optimum regulation, also exhibits optimized response behaviour.

Said problem is solved according to the invention by way of the subject matter of the independent claims. The dependent claims relate to advantageous embodiments.

The present invention is based on the general concept of a profile of a guide vane of a variable turbine geometry of a charger device being equipped with a concave recess at a profile nose in the region of a bottom side, wherein said recess is responsible for the variable turbine geometry being optimally sealed when the guide vanes are closed and furthermore exhibiting an opening characteristic even at a slightly open position, and thus a fast response behaviour. The charger device according to the invention thus has a variable turbine geometry with guide vanes which are mounted rotatably in a vane bearing ring and which have a top side which runs in convex fashion from the profile nose to a profile end. Here, according to the invention, the concave recess is arranged on a bottom side of the guide vanes at the profile nose. With the charger device according to the invention having the guide vanes according to the invention, it is possible to achieve optimum regulation owing to an opening characteristic of the guide vane profile in conjunction with a very low adjustment force. Owing to the convexly formed top side of the guide vane, it is furthermore possible to realize an optimized aerodynamic contour, which in turn is associated with high efficiency. By means of the recess provided at the profile nose in the region of the bottom side, it is furthermore possible for the individual guide vanes to bear against one another in relatively sealed fashion in the closed state. Even in an only slightly open position of the guide vane, that is to say in a so-called "min-flow position", it is possible by way of the recess in the flow impingement region, that is to say on the bottom side of the profile nose, for optimum impingement of flow on the turbine wheel to be achieved.

The bottom side of the guide vane expediently runs in concave fashion from the concave recess at the profile nose to the profile end, wherein a radius of curvature of the bottom side is greater than a radius of curvature of the recess. With such a design of the guide vane profile, it is possible to realize optimum flow impingement behaviour on the turbine wheel and thus relatively high efficiency.

In an advantageous refinement of the solution according to the invention, a radius of curvature R of the recess is defined as follows: $L/2>R>L/12$, wherein L represents the length of the guide vane. It is even preferable here for a radius of curvature R to lie in the range between $L/4>R>L/8$ and particular preferably in the range between $L/5>R>L/7$. By means of such a radius of curvature of the recess, it is possible to realize particularly optimized response behaviour and at the same time a high level of efficiency with low adjustment forces.

In a further advantageous embodiment of the solution according to the invention, the profile end of the respective guide vane is rounded with a radius of curvature R2, wherein the following applies: $R/15>R2>R/25$. Through such a selection of the radius of curvature R2 at the profile end of the guide vane, it can be achieved that, in the min-flow position of the guide vanes, the exhaust-gas flow is diverted optimally toward the turbine wheel.

An axis of rotation of the guide vane expediently lies on a profile centreline, wherein a spacing of the axis of rotation to the profile nose is smaller than a spacing to the profile end. Such an arrangement of the axis of rotation of the guide vanes relative to the guide vane profile likewise improves the adjustability, and furthermore ensures an opening characteristic of the individual guide vanes.

The present invention is also based on the general concept of specifying a guide vane for a variable turbine geometry as described above and/or a charger device as described above, which guide vane has a top side which runs in convex fashion from a profile nose to a profile end, and on which guide vane a concave recess is arranged on a bottom side of the guide vane at the profile nose. A guide vane of said type makes it possible to realize an improved opening characteristic and, owing to the low adjustment forces required, also easy and more precise regulability of the variable turbine geometry.

Further important features and advantages of the invention will emerge from the subclaims, from the drawings and from the associated description of the figures on the basis of the drawings.

It is self-evident that the features mentioned above and the features yet to be discussed below may be used not only in the respectively specified combination but also in other combinations or individually without departing from the scope of the present invention.

Preferred exemplary embodiments of the invention are illustrated in the drawings and will be discussed in more detail in the following description, wherein the same reference signs are used to denote identical or similar or functionally identical components.

DETAILED DESCRIPTION

Figure 1:
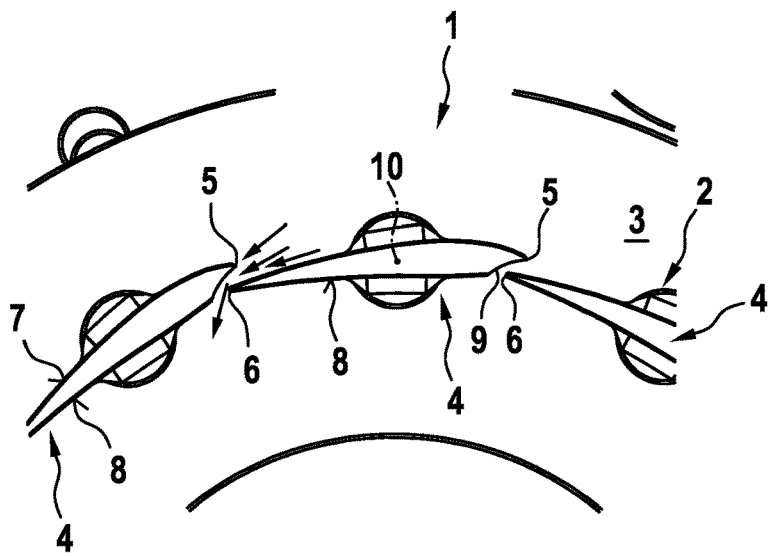
FIG. 1 shows a view of a variable turbine geometry of a charger device according to the invention with guide vanes slightly open.
Figure 2:
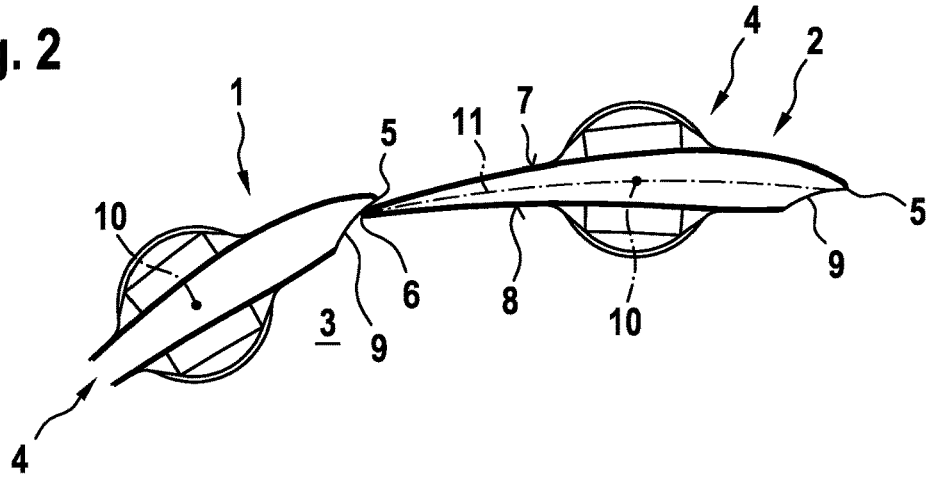
FIG. 2 is an illustration as in FIG. 1 but on an enlarged scale and with the guide vanes closed.

Correspondingly to FIG. 1, a charger device 1 according to the invention, which may for example be in the form of an exhaust-gas turbocharger in a motor vehicle, has a variable turbine geometry 2 with a vane bearing ring 3 and with guide vanes 4 mounted rotatably therein. Said guide vanes 4 are additionally illustrated in FIG. 2 and once again in the detail illustration of FIG. 3. With regard to the guide vanes 4, it can be seen that these have a top side 7 which runs in convex fashion from a profile nose 5 to a profile end 6. A concave recess 9 (cf. in particular also FIGS. 2 and 3) is arranged on a bottom side 8 of the guide vane 4 at the profile nose 6. Here, the bottom side 8 runs likewise in concave fashion from the concave recess 9 to the profile end 6, wherein a radius of curvature of the bottom side 8 is greater than a radius of curvature R of the recess 9.

Here, the radius of curvature R of the recess 9 is preferably defined as follows:

$$L/2>R>L/12$$

where L=length of the guide vane 4. The length of the guide vane 4 may for example be 18.2 mm.

Here, the radius of curvature R of the recess 9 is particularly preferably defined as follows:

$$L/4>R>L/8$$

where L again represents the length of the guide vane 4. In a particularly optimized form, the radius of curvature R of the recess 9 is $$L/5>R>L/7.$$

The profile end 6 is rounded, specifically preferably with a radius of curvature R which lies in the range of R/15>R2>R/25. It has been found that this ratio permits an optimum diversion of the exhaust-gas flow toward the turbine wheel in the min-flow position.

Figure 3:
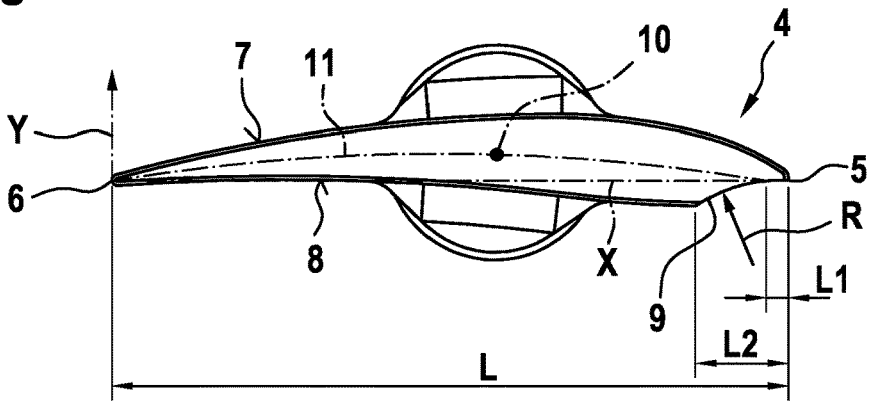
FIG. 3 is a detail illustration of a guide vane in profile.

Considering the recess 9 more closely in FIG. 3, it can be seen that the concave recess 9 begins not at the tip of the profile nose 5 but spaced apart from the latter by a spacing L1, wherein said spacing L1 may be approximately 0.5 mm. The total extent of the concave recess 9 in a longitudinal direction is in this case denoted by L2 in FIG. 3, wherein L2 may be approximately 2.5 mm.

Furthermore, in the case of the guide vane 4 according to the invention and the variable turbine geometry 2 according to the invention equipped with said guide vane, an axis of rotation 10 of the guide vanes 4 lies on a profile centreline L, wherein a spacing of the axis of rotation 10 to the profile nose 5 is smaller than a spacing to the profile end 6, which yields not only easier adjustability but also an improved opening characteristic.

Considering FIG. 2 once again, it can be seen that, when the guide vanes 4 are closed, the recess 9 of one guide vane 4 bears against the top side 7 of the profile end 6 of the adjacent guide vane 4, whereby relatively sealed closure of the variable turbine geometry is made possible. In a slightly open position of the guide vanes 4, as illustrated in FIG. 1, the recess 9 provided according to the invention yields improved response behaviour, because the recess 9 supports the opening movement of the individual guide vanes 4. In this way, however, it is possible for not only the opening characteristics of the guide vanes 4 or of the variable turbine geometry 2 to be positively influenced, but self-evidently also the efficiency.

If, as illustrated in FIG. 3, one places the guide vane 4 into a coordinate system with an X axis (abscissa) and a Y axis (coordinate) and, here, places the leading edge and trailing edge on the X axis, the profile centreline 10 has positive values for Y at every X position.

With the guide vanes 4 according to the invention and the variable turbine geometry 2 according to the invention or the charger device 1, it is possible, owing to an opening characteristic of the guide vanes 4 in conjunction with a very low adjustment force, to achieve optimum regulation of the charger device 1. Owing to the optimized aerodynamic contour, primarily at the convexly formed top side 7, it is furthermore possible to realize very high efficiency. When the guide vanes 4 are closed, these bear against one another with an optimum sealing action, whereby in particular, it is possible to positively support an engine braking operating mode. The recess 9 is however particularly advantageous in a situation in which the guide vanes 4 are slightly open (min-flow position) as illustrated in FIG. 1, because in this case, the recess 9 supports the opening movement of the guide vanes 4 when these are impinged on by flow, and thus the response behaviour is positively influenced.

The invention claimed is:

1. A charger device comprising:

a variable turbine geometry having guide vanes mounted rotatably in a vane bearing ring, each guide vane having a top side that runs continuously in convex fashion from a profile nose to a profile end, wherein a concave recess is arranged on a bottom side of each guide vane, and wherein for each guide vane, a radius of curvature of the recess is between ¼ and ⅛ of a length of the guide vane.

2. A charger device according to claim 1, wherein, for each guide vane, the bottom side runs in concave fashion from the concave recess to the profile end, and a radius of curvature of the bottom side is greater than a radius of curvature of the recess.

3. A charger device according to claim 1, wherein, for each guide vane, the radius of curvature of the recess is between ⅕ and ⅐ of a length of the guide vane.

4. A charger device according to claim 1, wherein, for each guide vane, the profile end is rounded with a radius of curvature that is between 1/15 and 1/25 of the radius of curvature of the recess.

5. A charger device according to claim 1, wherein an axis of rotation of each guide vane lies on a profile centreline, wherein a spacing of the axis of rotation to the profile nose is smaller than a spacing to the profile end.

6. A guide vane of a charger device, comprising:

a top side and a bottom side, the top side running in convex fashion from a profile nose to a profile end, a centerline from the profile nose to the profile end being continuous, and a concave recess arranged on the bottom side at the profile nose, wherein a radius of curvature of the recess is between ¼ and ⅛ of a length of the guide vane.

7. A guide vane according to claim 6, wherein the bottom side runs in concave fashion from the concave recess to the profile end, and a radius of curvature of the bottom side is greater than a radius of curvature of the recess.

8. A guide vane according to claim 6, wherein the radius of curvature of the recess is between ⅕ and ⅐ of a length of the guide vane.

9. A guide vane according to claim 6, wherein the profile end is rounded with a radius of curvature that is between 1/15 and 1/25 of a radius of curvature of the recess.

10. A guide vane according to claim 6, wherein an axis of rotation of the guide vane lies on a profile centreline, a spacing of the axis of rotation to the profile nose being smaller than a spacing to the profile end.

11. A charger device according to claim 2, wherein an axis of rotation of each guide vane lies on a profile centreline, wherein a spacing of the axis of rotation to the profile nose is smaller than a spacing to the profile end.

12. A charger device according to claim 5, wherein, for each guide vane, the profile end is rounded with a radius of curvature that is between 1/15 and 1/25 of the radius of curvature of the recess.

13. A charger device according to claim 3, wherein, for each guide vane, the profile end is rounded with a radius of curvature that is between 1/15 and 1/25 of the radius of curvature of the recess.

14. A charger device comprising:

a variable turbine geometry having guide vanes mounted rotatably in a vane bearing ring, each guide vane having:

a top side and a bottom side, the top side running continuously in convex fashion from a profile nose to a profile end, and a concave recess is arranged on a bottom side of the guide vane at the profile nose, wherein the bottom side runs in concave fashion from the concave recess to the profile end, and a radius of curvature of the bottom side is greater than a radius of curvature of the recess, wherein the profile end is rounded with a radius of curvature smaller than the radius of curvature of the recess, and wherein a radius of curvature of the recess is between ¼ and ⅛ of a length of the guide vane.

15. A charger device according to claim 1, wherein, for each guide vane, the recess is spaced apart from the profile nose.

* * * * *